US011326765B2

(12) United States Patent
Lim et al.

(10) Patent No.: US 11,326,765 B2
(45) Date of Patent: May 10, 2022

(54) LIGHTING DEVICE CAPABLE OF CONTROLLING LIGHT RADIATION DIRECTION

(71) Applicants: Hyundai Motor Company, Seoul (KR); Kia Motors Corporation, Seoul (KR)

(72) Inventors: Jung Wook Lim, Seoul (KR); Byoung Suk Ahn, Gwacheon-si (KR); Seung Sik Han, Hwaseong-si (KR); Sung Ho Park, Seoul (KR); Ki Hong Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/183,096

(22) Filed: Feb. 23, 2021

(65) Prior Publication Data

US 2022/0065426 A1 Mar. 3, 2022

(30) Foreign Application Priority Data

Sep. 3, 2020 (KR) ..... 10-2020-0112262

(51) Int. Cl.

| | |
|---|---|
| ***F21V 14/06*** | (2006.01) |
| ***F21V 29/76*** | (2015.01) |
| ***F21V 5/04*** | (2006.01) |
| ***F21S 41/63*** | (2018.01) |
| ***F21Y 115/10*** | (2016.01) |

(52) U.S. Cl.

CPC ..... *F21V 14/06* (2013.01); *F21S 41/63* (2018.01); *F21S 41/635* (2018.01); *F21V 5/04* (2013.01); *F21V 29/763* (2015.01); *F21Y 2115/10* (2016.08)

(58) Field of Classification Search

CPC ..... F21S 41/63–64; F21V 5/04; F21V 14/06; F21V 29/763

See application file for complete search history.

(56) References Cited

U.S. PATENT DOCUMENTS

2018/0176486 A1* 6/2018 Kadowaki ..... F21V 14/02

FOREIGN PATENT DOCUMENTS

KR 10-2010-0069465 A 6/2010
KR 10-2017-0011495 A 2/2017

(Continued)

*Primary Examiner* — Jason M Han

(74) *Attorney, Agent, or Firm* — Morgan, Lewis & Bockius LLP

(57) ABSTRACT

A lighting device configured for controlling a light radiation direction thereof, may include a housing provided with a light source; a lens unit provided in the housing, the lens unit being configured to concentrate the light generated from the light source; a length-variable unit mounted to the housing, the length-variable unit being configured so that a length thereof is changed, in a response to application of electricity thereto, in a direction in which the position of the lens unit is changed; and a controller configured to control a light radiation direction of the lens unit by setting a voltage of the electricity to be applied to the length-variable unit so that a length of the length-variable unit is changed according to a set voltage and the position of the lens unit is changed according to a change in the length of the length-variable unit.

14 Claims, 6 Drawing Sheets

(56) References Cited

FOREIGN PATENT DOCUMENTS

| | | | |
|---|---|---|---|
| KR | 10-1787058 | B1 | 10/2017 |
| KR | 10-1939197 | B1 | 1/2019 |
| KR | 10-1966497 | B1 | 4/2019 |
| KR | 10-2019-0051611 | A | 5/2019 |

* cited by examiner

LIGHTING DEVICE CAPABLE OF CONTROLLING LIGHT RADIATION DIRECTION

CROSS-REFERENCE TO THE RELATED APPLICATION

The present application claims priority to Korean Patent Application No. 10-2020-0112262, filed on Sep. 3, 2020, the entire contents of which is incorporated herein for all purposes by this reference.

BACKGROUND OF THE INVENTION

Field of the Invention

The present invention relates to a lighting device configured for controlling a light radiation direction and having a simple structure for controlling the light radiation direction.

Description of Related Art

In general, a vehicle is provided with various types of lighting devices to facilitate recognition of objects present near the vehicle when traveling in a dimly lit environment and to notify other vehicles or pedestrians of the traveling state of the vehicle. Among the vehicle lighting devices, headlamps, also called headlights, are configured to illuminate the area in front of the vehicle.

Because headlamps are fixedly mounted to the front side of a vehicle, the headlamps may dazzle drivers of other vehicles or pedestrians or may be incapable of appropriately radiating light toward the area in front of the subject vehicle, thus failing to illuminate the field of view of the driver of the subject vehicle, depending on the driving conditions (e.g., change in the vehicle posture), road conditions, and ambient conditions.

Therefore, a configuration for aiming an optical module is applied to headlamps. However, due to a trend of reduction in the size of an external lamp, it is difficult to aim an optical module in a small or slim lamp. An actuator is required to aim an optical module. However, because an actuator is relatively large, space for mounting the actuator needs to be secured. Furthermore, in the case in which a plurality of optical modules is provided, each of the optical modules requires an individual actuator, and thus it is difficult to make headlamps small or slim.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a lighting device configured for controlling a light radiation direction and having a simple structure for controlling the light radiation direction thereof, reducing the overall volume thereof when a plurality of lamp modules is applied thereto.

In accordance with various aspects of the present invention, the above and other objects may be accomplished by the provision of a lighting device configured for controlling a light radiation direction thereof, the lighting device including a housing provided with a light source configured to radiate light, a lens unit provided in the housing to be changeable in position thereof and configured to concentrate light generated from the light source, a length-variable unit mounted to the housing to be connected to the lens unit and configured such that the length thereof is changed in a response to application of electricity thereto in the direction in which the position of the lens unit is configured for being changed to change the position of the lens unit, and a controller configured to control a light radiation direction of the lens unit by setting the voltage of electricity to be applied to the length-variable unit so that the length of the length-variable unit is changed according to the set voltage and the position of the lens unit is changed according to the change in the length of the length-variable unit.

The housing may include a through-hole formed at a position of the housing corresponding to the lens unit. The lens unit may include a condensing lens portion formed to concentrate the light incident thereon from the light source and a sliding portion extending from the periphery of the condensing lens portion to be slidably inserted into the through-hole.

The length-variable unit may be mounted outside the housing, and may be connected to the sliding portion of the lens unit so that the sliding portion moves through the through-hole according to the change in the length of the length-variable unit.

The through-hole may include an upper through-hole formed in the housing at a position above the condensing lens portion of the lens unit and a lower through-hole formed in the housing at a position below the condensing lens portion of the lens unit. The sliding portion may include an upper sliding portion extending from an upper portion of the condensing lens portion to be inserted into the upper through-hole and a lower sliding portion extending from a lower portion of the condensing lens portion to be inserted into the lower through-hole.

The lighting device may further include an elastic restoring unit having elastic restoring force to return the lens unit, having been moved by the length-variable unit, to the original position of the lens unit. One of the upper sliding portion and the lower sliding portion of the lens unit may be connected to the length-variable unit, and the remaining one of the upper sliding portion and the lower sliding portion may be connected to the elastic restoring unit.

The length-variable unit may include a first length-variable unit and a second length-variable unit configured to change in length in different directions from each other upon application of electricity thereto. The first length-variable unit and the second length-variable unit may be respectively connected to the upper sliding portion and the lower sliding portion of the lens unit.

The length-variable unit may include a support portion configured to be bendable and connected to the lens unit and a piezoelectric portion attached to the support portion and configured to be changeable in length upon receiving of the electricity to cause the support portion to bend.

The lighting device may further include a light distribution lens mounted in the housing so that the light that has passed through the lens unit is incident thereon and is radiated in a set direction therethrough.

The housing may be provided with a moving shaft vertically penetrating the housing in an upward-downward direction to be movable. The light distribution lens may be connected to the moving shaft to be tilted according to the change in the position of the moving shaft.

The housing may be further provided with a light-distribution-control length-variable unit connected to the moving shaft.

The controller may receive vehicle posture information according to movement of a vehicle and may control the length-variable unit to move the lens unit upwards or downwards based on the posture of the vehicle according to movement of the vehicle in the upward-downward direction thereof.

The controller may receive vehicle travel information on the travel state of a vehicle and may control the length-variable unit to move the lens unit upwards or downwards according to the traveling speed of the vehicle.

The controller may receive temperature information and may control the length-variable unit based on pre-stored data on the influence of temperature on the length-variable unit to compensate for a change in the length of the length-variable unit caused by the temperature.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
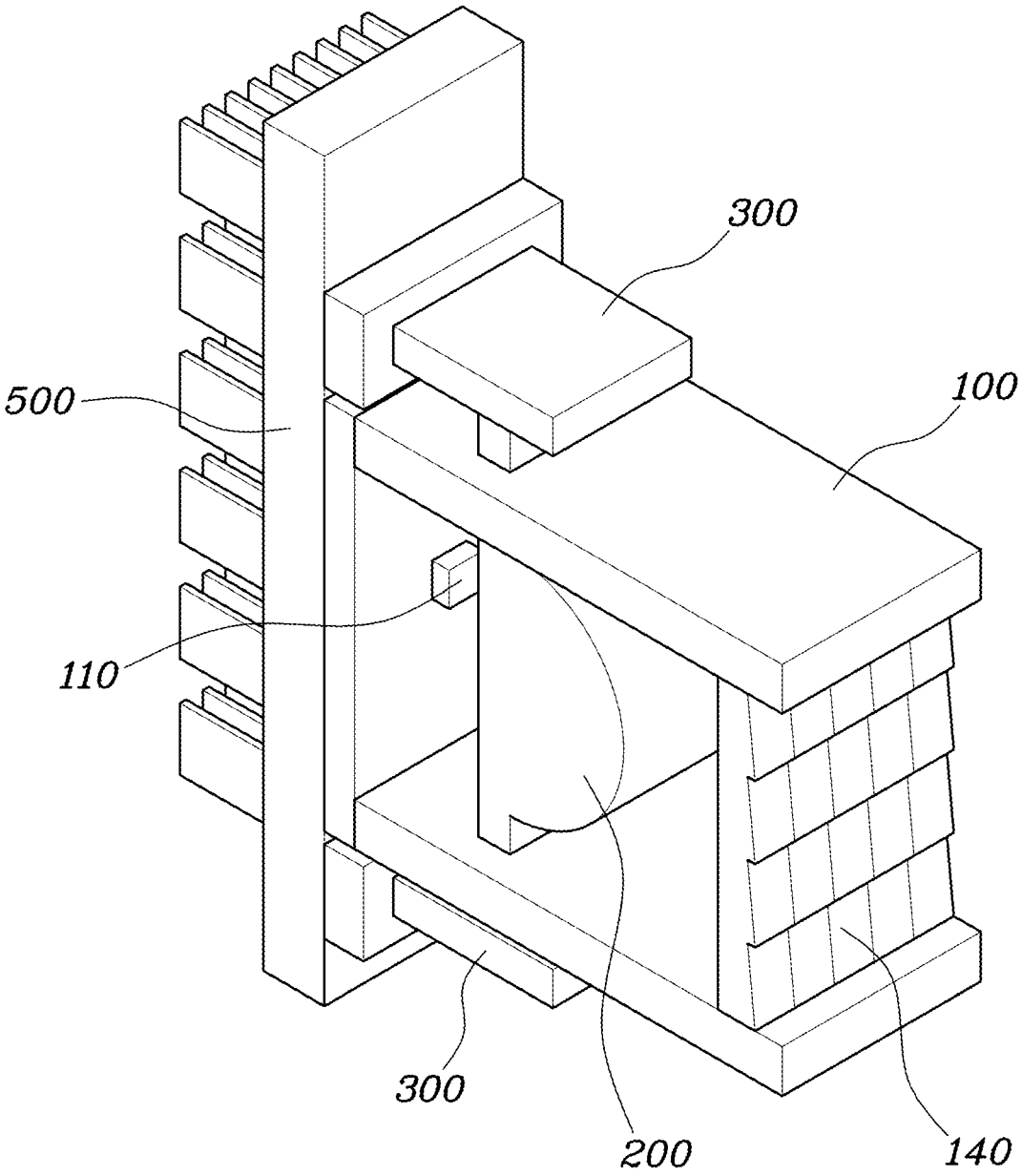
FIG. 1 is a view showing a lighting device configured for controlling a light radiation direction according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, a lighting device configured for controlling a light radiation direction according to exemplary embodiments of the present invention will be described with reference to the accompanying drawings.

Figure 2:
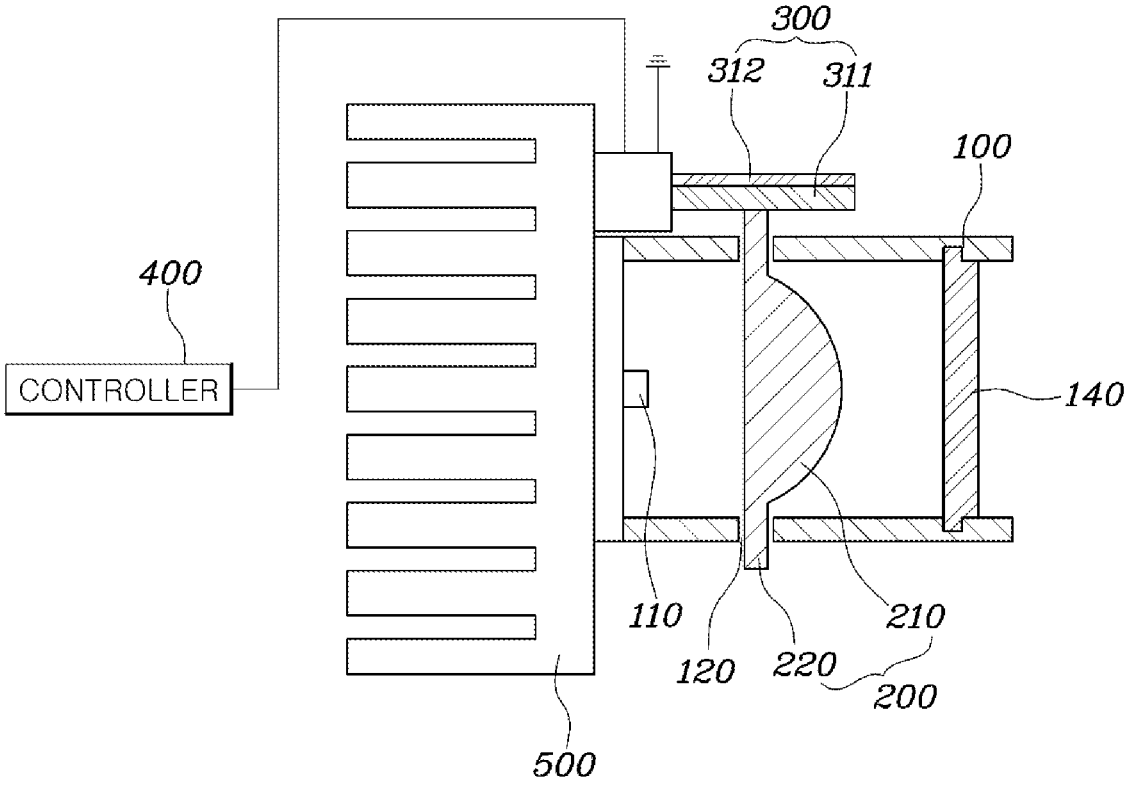
FIG. 2 is a view showing an exemplary embodiment of the lighting device configured for controlling a light radiation direction thereof.
Figure 3:
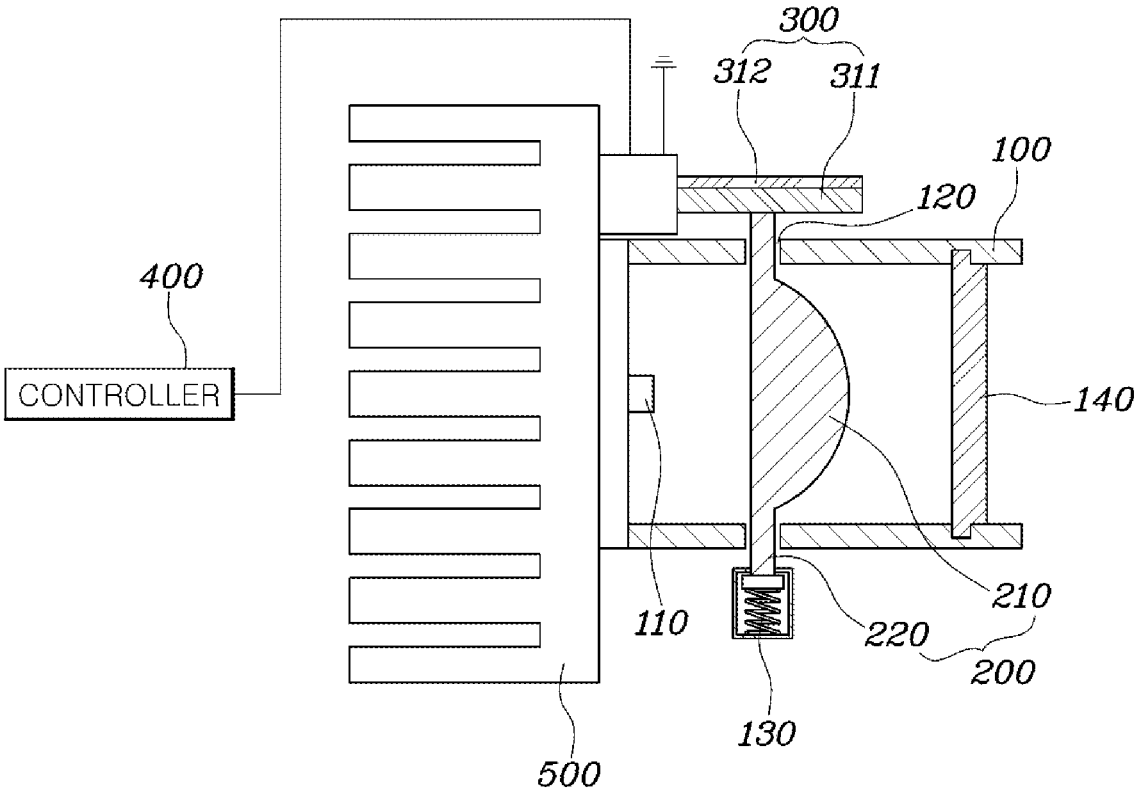
FIG. 3 is a view showing another exemplary embodiment of the lighting device configured for controlling a light radiation direction thereof.
Figure 4:
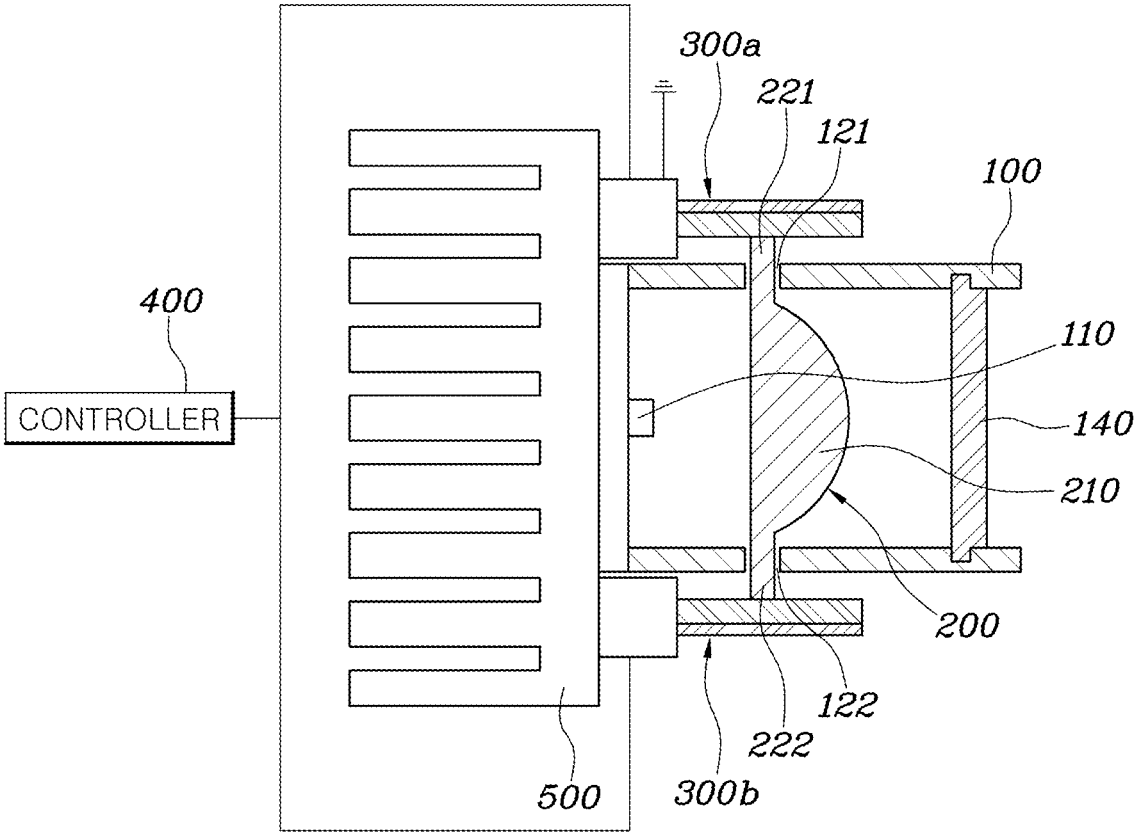
FIG. 4 is a view showing various exemplary embodiments of the lighting device configured for controlling a light radiation direction thereof.
Figure 5:
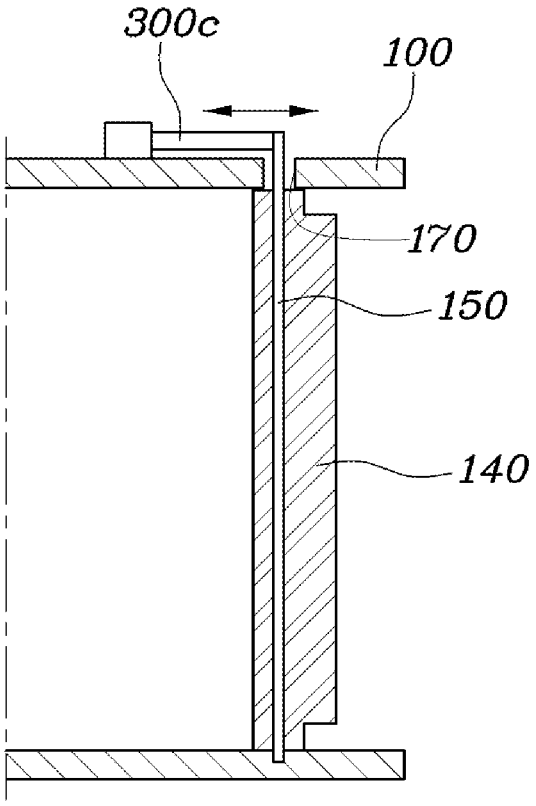
FIG. 5 is a side-sectional view for explaining a light distribution lens of the lighting device configured for controlling a light radiation direction thereof.
Figure 6:
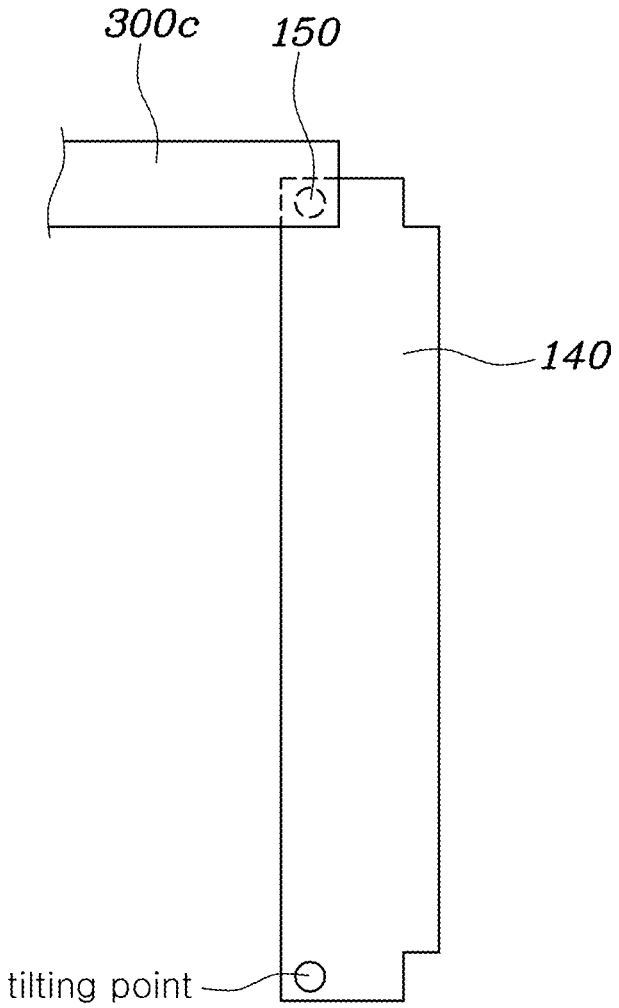
FIG. 6 is a top view for explaining the light distribution lens of the lighting device configured for controlling a light radiation direction thereof.

FIG. 1 is a view showing a lighting device configured for controlling a light radiation direction according to various exemplary embodiments of the present invention. FIG. 2 is a view showing an exemplary embodiment of the lighting device configured for controlling a light radiation direction thereof. FIG. 3 is a view showing another exemplary embodiment of the lighting device configured for controlling a light radiation direction thereof. FIG. 4 is a view showing various exemplary embodiments of the lighting device configured for controlling a light radiation direction thereof. FIG. 5 is a side-sectional view for explaining a light distribution lens of the lighting device configured for controlling a light radiation direction thereof. FIG. 6 is a top view for explaining the light distribution lens of the lighting device configured for controlling a light radiation direction thereof.

A lighting device configured for controlling a light radiation direction according to various exemplary embodiments of the present invention, as shown in FIG. 1 and FIG. 2, includes a housing 100, which is provided with a light source 110 configured to radiate light, a lens unit 200, which is provided in the housing 100 to be changeable in position thereof and which concentrates light generated from the light source 110, a length-variable unit 300, which is mounted to the housing 100 to be connected to the lens unit 200 and is configured such that the length thereof is configured for being changed, in a response to application of electricity thereto, in a direction in which the position of the lens unit 200 is configured for being changed to change the position of the lens unit 200, and a controller 400, which controls a light radiation direction by setting the voltage of electricity to be applied to the length-variable unit 300 so that the length of the length-variable unit 300 is changed according to the set voltage and the position of the lens unit 200 is changed according to the change in the length of the length-variable unit 300.

The light source 110, the lens unit 200, and the length-variable unit 300, which are mounted to the housing 100, will now be described in greater detail. An electric line is connected to the length-variable unit 300, and the length of the length-variable unit 300 is changed according to the voltage of electricity applied thereto under the control of the controller 400. The housing 100 may be provided with a heat dissipation unit 500 to dissipate the heat generated from the light source 110.

The light source 110 may be implemented as a light-emitting diode (LED), and the lens unit 200 may be implemented as a condensing lens. Since the lens unit 200 is mounted to be changeable in position thereof inside the housing 100, the point on which the light generated from the light source 110 is radiated is changed in position thereof. That is, in the case in which the lens unit 200 is implemented as a condensing lens such as an aspherical lens, the center axis of the light generated from the light source 110 is moved according to the movement of the condensing lens due to the optical characteristics of the condensing lens, and thus the external point on which the light is radiated is changed in position thereof.

The length-variable unit 300, which changes the position of the lens unit 200, is configured to be changeable in length upon application of electricity thereto. The length-variable unit 300 is configured as a piezoelectric element, which changes in length or bends upon receiving the electricity, whereby the lens unit 200 connected to the length-variable unit 300 is moved inside the housing 100.

Described in detail, the length-variable unit 300 may include a support portion 311, which is configured to be bendable and to which the lens unit 200 is connected, and a piezoelectric portion 312, which is attached to the support portion 311 and is configured to be changeable in length upon receiving of the electricity to cause the support portion 311 to bend.

The support portion 311 may be made of a material that bends when a force having a predetermined magnitude or greater is applied thereto, and the piezoelectric portion 312 may be made of a material that changes in length according to the voltage of electricity applied thereto. Accordingly, when electricity having a voltage set by the controller 400 is applied thereto, the piezoelectric portion 312 changes in length, which causes the support portion 311 to bend. Alternatively, the length-variable unit 300 may be configured to change the position of the lens unit 200 using only the change in the length of the piezoelectric portion 312. However, in the case of using only the change in the length of the piezoelectric portion 312, the piezoelectric portion 312 needs to be mounted perpendicular to the lens unit 200, leading to an increase in the size of the installation space of the lighting device and an limitation to the extent to which the lens unit 200 may be changed in orientation.

Therefore, as described above, the length-variable unit 300 according to various exemplary embodiments of in various aspects of the present invention, the support portion 311 bends due to the change in the length of the piezoelectric portion 312 upon application of electricity thereto. Accordingly, the lens unit 200 connected to the length-variable unit 300 is moved in the direction in which the length-variable unit 300 bends.

The controller 400 controls the length-variable unit 300 such that electricity having a voltage set according to a required light radiation direction is applied to the length-variable unit 300. Accordingly, the lens unit 200 is moved by the change in the length of the length-variable unit 300. Here, the lamp module, in which the light source 110, the lens unit 200, and the length-variable unit 300 are mounted to the housing 100, may be provided in a plural number. In the instant case, the controller 400 may individually control the respective lamp modules to radiate light beams in various patterns.

As will be described in greater detail below, the housing 100 has a through-hole 120 formed therein at a position corresponding to the lens unit 200. The lens unit 200 includes a condensing lens portion 210, which is formed to concentrate the light incident thereon from the light source 110, and a sliding portion 220, which extends from the periphery of the condensing lens portion 210 to be slidably inserted into the through-hole 120.

As shown in FIG. 2, the sliding portion 220 of the lens unit 200 provided inside the housing 100 is inserted into the through-hole 120, and the lens unit 200 may be moved in the direction in which the sliding portion 220 slides through the through-hole 120. That is, the lens unit 200 is configured such that the condensing lens portion 210 is formed in an aspherical shape to concentrate the light generated from the light source 110 and the sliding portion 220 extends from the periphery of the condensing lens portion 210. The sliding portion 220 extends from the periphery of the condensing lens portion 210 to avoid interference with the light passing through the condensing lens portion 210. Furthermore, the sliding portion 220 passes through the through-hole 120 in the housing 100, and extends to be connected to the length-variable unit 300. The sliding portion 220 slides through the through-hole 120 due to the change in the length of the length-variable unit 300, whereby the position of the condensing lens portion 210 is changed.

As can be seen from FIG. 2, the length-variable unit 300 is mounted outside the housing 100, and is connected to the sliding portion 220 of the lens unit 200 so that the sliding portion 220 moves through the through-hole 120 according to changes in the length of the length-variable unit 300. The length-variable unit 300 may alternatively be mounted inside the housing 100. However, it is preferable for the length-variable unit 300 to be mounted outside the housing 100 to avoid interference with the housing 100 or with the path along which the light generated from the light source 110 travels when the length-variable unit 300 changes in shape. Since the length-variable unit 300 is connected to the sliding portion 220 of the lens unit 200, the sliding portion 220 is drawn out of or inserted into the through-hole 120 according to the bending of the length-variable unit 300. Accordingly, the position of the lens unit 200 is shifted in the direction in which the length-variable unit 300 bends, changing the light radiation direction thereof.

The through-hole 120 of the housing 100 may have an upper through-hole 121 formed therein at a position above the condensing lens portion 210 of the lens unit 200 and a lower through-hole 122 formed therein at a position below the condensing lens portion 210 of the lens unit 200, and the sliding portion 220 of the lens unit 200 may include an upper sliding portion 221 extending from an upper portion of the condensing lens portion 210 to be inserted into the upper through-hole 121 and a lower sliding portion 222 extending from a lower portion of the condensing lens portion 210 to be inserted into the lower through-hole 122. Accordingly, the position of the lens unit 200 may be changed inside the housing 100 in the upward-downward direction thereof, and thus the path along which the light generated from the light source 110 travels may be moved in the upward-downward direction thereof. Furthermore, the lens unit 200 may be moved stably in the upward-downward direction due to the upper and lower through-holes 121 and 122, which are formed in the housing 100 at positions corresponding to the upper and lower portions of the lens unit 200, and the upper and lower sliding portions 221 and 222 of the lens unit 200, which are respectively slidably inserted into the upper and lower through-holes 121 and 122.

Accordingly, since the lens unit 200 has a plurality of sliding portions, the upper sliding portion 221 and the lower sliding portion 222, the length-variable unit 300 may be provided in a plural number, or a separate unit of returning the lens unit 200 to the original position thereof may be further provided.

As various exemplary embodiments of the present invention, as shown in FIG. 3, one of the upper sliding portion 221 and the lower sliding portion 222 of the lens unit 200 may be connected to the length-variable unit 300, and the other one thereof may be connected to an elastic restoring unit 130, which has elastic restoring force for returning the lens unit 200, which has been moved by the length-variable unit 300, to the original position thereof.

FIG. 3 illustrates a configuration in which the length-variable unit 300 is connected to the upper sliding portion 221 of the lens unit 200 and the elastic restoring unit 130 is connected to the lower sliding portion 222 of the lens unit 200. The elastic restoring unit 130 may be implemented as a spring. When electricity is applied to the length-variable unit 300, the position of the lens unit 200 is changed, and when electricity is not applied to the length-variable unit 300, the lens unit 200 may be returned to the original position thereof by the elastic restoring force of the elastic restoring unit 130. In the case in which the length-variable unit 300 is configured to bend upwards upon application of the electricity thereto and the elastic restoring unit 130 is implemented as a compression spring, when electricity is applied to the length-variable unit 300, the length-variable unit 300 is bent upwards, and accordingly, the lens unit 200 is moved upwards. When electricity is not applied to the length-variable unit 300, the lens unit 200 may be moved downwards to the original position thereof by the elastic restoring unit 130.

As described above, according to the exemplary embodiment of the present invention, the lens unit 200 may be changed in position by the length-variable unit 300, and may be returned to the original position thereof by the elastic restoring unit 130.

As another exemplary embodiment of the present invention, as shown in FIG. 4, the length-variable unit 300 may include a first length-variable unit 300*a* and a second length-variable unit 300*b*, which change in length in different directions from each other upon application of electricity thereto. The first length-variable unit 300*a* and the second length-variable unit 300*b* may be respectively connected to the upper sliding portion 221 and the lower sliding portion 222 of the lens unit 200.

The first length-variable unit 300*a* and the second length-variable unit 300*b* have the same configuration. However, the first length-variable unit 300*a* and the second length-variable unit 300*b* may be disposed in the opposite orientation to bend in opposite directions upon application of electricity thereto. Alternatively, the first length-variable unit 300*a* may be configured to bend in the manner of expanding upon receiving the electricity, and the second length-variable unit 300*b* may be configured to bend in the manner of contracting upon application of electricity thereto.

In the case in which the first length-variable unit 300*a* is configured to bend upwards upon application of the electricity thereto and the second length-variable unit 300*b* is configured to bend downwards upon receiving the electricity, when electricity is applied to the first length-variable unit 300*a*, the lens unit 200 is moved upwards, and when electricity is applied to the second length-variable unit 300*b*, the lens unit 200 is moved downwards.

As described above, according to the exemplary embodiment of the present invention, it is possible to precisely control the position of the lens unit 200 by controlling the bending of the first length-variable unit 300*a* and the second length-variable unit 300*b*.

As shown in FIG. 5 and FIG. 6, the lighting device according to various exemplary embodiments of the present invention may further include a light distribution lens 140, which is disposed in the housing 100 so that the light that has passed through the lens unit 200 is incident thereon and is radiated in a set direction therethrough. That is, the light source 110, the lens unit 200, and the light distribution lens 140 are sequentially disposed inside the housing 100 in the direction in which light travels. The light distribution lens 140 is configured to adjust a light distribution angle. The light radiation surface of the light distribution lens 140 has a plurality of refraction surfaces, by which the light radiation direction is determined.

The light distribution lens 140 is mounted in the housing to be tiltable in the forward-backward direction thereof. The housing 100 is provided with a moving shaft 150, which is provided to penetrate the housing 100 at a position opposite to the tilting point of the light distribution lens 140 to vertically extend in the upward-downward direction and to be connected to the light distribution lens 140. Thus, the light distribution lens 140 may be tilted according to a change in the position of the moving shaft 150. Furthermore, the housing 100 may be further provided with a light-distribution-control length-variable unit 300*c*, which is connected to the moving shaft 150. Accordingly, the light distribution lens 140 may be tilted inside the housing 100 according to movement of the moving shaft 150 upon application of electricity to the light-distribution-control length-variable unit 300*c*.

Described in detail, the light-distribution-control length-variable unit 300*c*, which is provided at the housing 100, changes in length under the control of the controller 400, and the moving shaft 150, which is provided to vertically penetrate the housing 100 and is connected to the light-distribution-control length-variable unit 300*c*, is moved by the change in the length of the light-distribution-control length-variable unit 300*c*. The light-distribution-control length-variable unit 300*c* may be configured to change in length upon receiving the electricity, and may be connected to an end portion of the moving shaft 150 so that the moving shaft 150 is moved by the change in the length of the light-distribution-control length-variable unit 300*c*. Furthermore, the light-distribution-control length-variable unit 300*c* may be formed to be elastically deformable so that the moving shaft 150 is smoothly moved when the light-distribution-control length-variable unit 300*c* changes in length.

As described above, when the light-distribution-control length-variable unit 300*c* changes in length under the control of the controller 400, the light distribution lens 140, to which the moving shaft 150 is connected, is tilted about the tilting point thereof by the movement of the moving shaft 150, controlling the light radiation direction in the lateral direction thereof.

In an exemplary embodiment of the present invention, a sliding slot 170 is provided in the housing 100 and an end of the moving shaft 150 is engaged in the sliding slot 170 to slide in the sliding slot 170.

The controller 400 may be configured to receive vehicle posture information according to the movement of a vehicle and to control the length-variable unit 300 to move the lens unit 200 upwards or downwards based on the posture of the vehicle according to the movement thereof in the upward-downward direction thereof.

Here, the vehicle posture information is information on whether the vehicle hits a bump or bounces, which is detected by, for example, a suspension sensor, a vertical acceleration sensor, a height sensor, or an image sensor. The controller 400 controls the length-variable unit 300 based on the vehicle posture information to change the position of the lens unit 200. Upon receiving posture information indicating that the front side of the vehicle is tilted downwards, for example, when the vehicle hits a bump, the controller 400 controls the length-variable unit 300 such that the lens unit 200 is moved upwards. In contrast, upon receiving posture information indicating that the front side of the vehicle is tilted upwards, for example, when the vehicle bounces, the controller 400 controls the length-variable unit 300 such that the lens unit 200 is moved downwards. In the present way, the position of the lens unit 200 is controlled according to the posture of the vehicle, making it possible to accurately radiate light on a desired point.

Furthermore, the controller 400 may also be configured to receive vehicle travel information on the travel state of the vehicle and to control the length-variable unit 300 to move the lens unit 200 upwards or downwards according to the traveling speed of the vehicle.

Here, the vehicle travel information is information on the traveling speed of the vehicle, which is detected by a speed sensor. The controller 400 controls the length-variable unit 300 according to the traveling speed of the vehicle to change the position of the lens unit 200. For example, when the vehicle travels at a relatively high speed, the controller 400 controls the length-variable unit 300 such that the lens unit 200 is moved upwards to illuminate an area a long distance ahead of the vehicle. In contrast, when the vehicle travels at a relatively low speed, the controller 400 controls the length-variable unit 300 such that the lens unit 200 is moved downwards to illuminate an area a short distance ahead of the vehicle. In the present way, the position of the lens unit 200 is controlled according to the traveling speed of the vehicle, securing stable and safe driving of the vehicle.

Furthermore, the controller 400 may also be configured to receive temperature information and to control the length-variable unit 300 based on pre-stored data on the influence of temperature on the length-variable unit 300, compensating for the change in the length of the length-variable unit 300 caused by changes in temperature.

The controller 400 may receive temperature information from an external temperature sensor, and data on the influence of temperature on the length-variable unit 300 may be pre-stored in the controller 400. Due to the characteristics of the material thereof which is changeable in length, the length-variable unit 300 may be changed in length upon changes in temperature. Therefore, variation in the length of the length-variable unit 300 caused by temperature may be determined in advance through experimentation, and data on the same may be obtained, based on which it is possible to compensate for changes in the length of the length-variable unit 300 caused by the external temperature.

Accordingly, even though the length-variable unit 300 is changed in length by the temperature, the controller 400 may compensate for the change in the length of the length-variable unit 300 based on the data pre-stored therein, accurately controlling the position of the lens unit 200.

As is apparent from the above description, a lighting device according to various exemplary embodiments of the present invention configured as described above is configured for controlling a light radiation direction by changing the position of a condensing lens, which concentrates light, using a piezoelectric element. Due to the structure in which the position of the condensing lens is controlled using the piezoelectric element, it is not necessary to use an actuator, which has a relatively large size, thus making it possible to manufacture a small or slim lamp module and to reduce the overall volume of the lighting device when a plurality of lamp modules is applied thereto.

Furthermore, the term related to a control device such as "controller", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention. The controller according to exemplary embodiments of the present invention may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors.

The control device may be at least one microprocessor operated by a predetermined program which may include a series of commands for carrying out the method included in the aforementioned various exemplary embodiments of the present invention.

The aforementioned invention can also be embodied as computer readable codes on a computer readable recording medium. The computer readable recording medium is any data storage device that can store data which may be thereafter read by a computer system. Examples of the computer readable recording medium include hard disk drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet).

In various exemplary embodiments of the present invention, each operation described above may be performed by a controller, and the controller may be configured by a plurality of controllers, or an integrated single controller.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A lighting apparatus of controlling a light radiation direction, the lighting apparatus including:

a housing mounted with a light source configured to radiate light;

a lens unit mounted in the housing to be changeable in position thereof, the lens unit being configured to concentrate the light generated from the light source;

a length-variable unit mounted to the housing and connected to the lens unit, the length-variable unit being configured so that a length thereof is changed, in a response to application of electricity thereto, in a direction in which the position of the lens unit is changed;

wherein the length-variable unit includes a support portion configured to be bendable and connected to the lens unit and the housing; and a piezoelectric portion attached to the support portion and connected to the housing and configured to be changeable in length thereof upon receiving of the electricity to cause the support portion to bend; and a controller configured to control a light radiation direction of the lens unit by setting a voltage of the electricity to be applied to the length-variable unit so that a length of the length-variable unit is changed according to a set voltage and the position of the lens unit is changed according to a change in the length of the length-variable unit.

2. The lighting apparatus of claim 1, wherein the housing includes a through-hole formed at a position of the housing corresponding to the lens unit, and wherein the lens unit includes:

a condensing lens portion formed to concentrate the light incident thereon from the light source; and a sliding portion extending from a periphery of the condensing lens portion to be slidably inserted into the through-hole.

3. The lighting apparatus of claim 2, wherein the length-variable unit is mounted outside the housing, and is connected to the sliding portion of the lens unit so that the sliding portion moves through the through-hole according to a change in the length of the length-variable unit.

4. The lighting apparatus of claim 3, wherein the through-hole includes:

an upper through-hole formed in the housing at a position above the condensing lens portion of the lens unit; and a lower through-hole formed in the housing at a position below the condensing lens portion of the lens unit, and wherein the sliding portion includes:

an upper sliding portion extending from an upper portion of the condensing lens portion to be inserted into the upper through-hole; and a lower sliding portion extending from a lower portion of the condensing lens portion to be inserted into the lower through-hole.

5. The lighting apparatus of claim 4, further including:

an elastic restoring unit having elastic restoring force to return the lens unit, having been moved by the length-variable unit, to an original position of the lens unit, wherein one of the upper sliding portion and the lower sliding portion of the lens unit is connected to the length-variable unit, and a remaining one of the upper sliding portion and the lower sliding portion is connected to the elastic restoring unit.

6. The lighting apparatus of claim 4, wherein the length-variable unit includes a first length-variable unit and a second length-variable unit configured to change in length in different directions from each other upon receiving the electricity, and wherein each of the first length-variable unit and the second length-variable unit is connected to the upper sliding portion and the lower sliding portion of the lens unit, respectively.

7. The lighting apparatus of claim 1, further including:

a light distribution lens mounted in the housing so that the light that has passed through the lens unit is incident thereon and is radiated in a set direction therethrough.

8. The lighting apparatus of claim 7, wherein the housing is mounted with a moving shaft vertically penetrating the housing in an upward-downward direction to be movable, and wherein the light distribution lens is connected to the moving shaft to be tilted according to a change in position of the moving shaft.

9. The lighting apparatus of claim 8, wherein the housing is further mounted with a light-distribution-control length-variable unit connected to the moving shaft.

10. The lighting apparatus of claim 9, wherein a sliding slot is provided in the housing, and wherein a first end of the moving shaft is pivotally connected to the housing and a second end of the moving shaft is connected to the light-distribution-control length-variable unit through the sliding slot to move in an axial direction of the housing along the sliding slot.

11. The lighting apparatus of claim 1, wherein the controller is configured to receive vehicle posture information according to movement of a vehicle and is configured to control the length-variable unit to move the lens unit upwards or downwards based on a posture of the vehicle according to movement of the vehicle in an upward-downward direction thereof.

12. The lighting apparatus of claim 1, wherein the controller is configured to receive vehicle travel information on a travel state of a vehicle and is configured to control the length-variable unit to move the lens unit upwards or downwards according to a traveling speed of the vehicle.

13. The lighting apparatus of claim 1, wherein the controller is configured to receive temperature information and is configured to control the length-variable unit based on pre-stored data on an influence of temperature on the length-variable unit to compensate for a change in length of the length-variable unit caused by the temperature.

14. The lighting apparatus of claim 1, wherein the housing includes a heat dissipation unit to dissipate a heat generated from the light source.

* * * * *